US007694659B2

(12) United States Patent
Ikeda et al.

(10) Patent No.: US 7,694,659 B2
(45) Date of Patent: Apr. 13, 2010

(54) ROCKER ARM

(75) Inventors: Takaaki Ikeda, Hamura (JP); Yoshitaka Waseda, Nissin (JP)

(73) Assignee: JTEKT Corporation, Osaka-shi, Osaka (JP)

( * ) Notice: Subject to any disclaimer, the term of this patent is extended or adjusted under 35 U.S.C. 154(b) by 0 days.

(21) Appl. No.: 11/918,447

(22) PCT Filed: Apr. 14, 2006

(86) PCT No.: PCT/JP2006/307945

§ 371 (c)(1),
(2), (4) Date: Oct. 15, 2007

(87) PCT Pub. No.: WO2006/112397

PCT Pub. Date: Oct. 26, 2006

(65) Prior Publication Data

US 2009/0064953 A1 Mar. 12, 2009

(30) Foreign Application Priority Data

Apr. 14, 2005 (JP) ..... 2005-117151

(51) Int. Cl.
*F01L 1/18* (2006.01)

(52) U.S. Cl. ..... 123/90.39; 74/559; 29/888.2

(58) Field of Classification Search ..... 123/90.39, 123/90.44; 74/559, 567, 569; 29/888.2
See application file for complete search history.

(56) References Cited

U.S. PATENT DOCUMENTS 6,523,514 B1 * 2/2003 Motohashi ..... 123/90.39
6,612,276 B2 9/2003 Cecur
6,889,643 B2 5/2005 Motohashi
7,043,836 B2 5/2006 Motohashi
2002/0108594 A1 8/2002 Cecur
2004/0000277 A1 1/2004 Motohashi
2004/0000278 A1 1/2004 Motohashi

FOREIGN PATENT DOCUMENTS

EP 1 122 408 A1 8/2001
EP 1 157 193 11/2001
EP 1 233 150 A2 8/2002

(Continued)

OTHER PUBLICATIONS

Form PCT/IB/304.

(Continued)

*Primary Examiner*—Ching Chang
(74) *Attorney, Agent, or Firm*—McGinn IP Law Group, PLLC

(57) ABSTRACT

A rocker arm formed of material in a shape of sheet has a pair of side wall portions, a connection portion for a valve stem receiving portion and a connection portion for a pivot receiving portion which interconnect the side wall portions, and an open portion for arranging a roller which is formed between the two connection portions. A distance between outer side surfaces of the pair of side wall portions in the connection portion for the valve stem receiving portion is reduced in a direction from upper edges to lower edges in a step-like shape having two or more step differences, whereby a first outer side surface and a second outer side surface are formed.

17 Claims, 11 Drawing Sheets

FOREIGN PATENT DOCUMENTS

| | | | |
|---|---|---|---|
| EP | 1 357 257 | A2 | 10/2003 |
| EP | 1 375 829 | A1 | 1/2004 |
| EP | 1 375 830 | A1 | 1/2004 |
| JP | 2001-55912 | | 2/2001 |
| JP | 2001-191139 | | 7/2001 |
| JP | 2003-138913 | | 5/2003 |
| JP | 2003-138914 | | 5/2003 |
| JP | 2003-343695 | | 12/2003 |
| JP | 2004-25240 | | 1/2004 |
| JP | 2004-27967 | | 1/2004 |
| JP | 2004-132303 | | 4/2004 |

OTHER PUBLICATIONS

Form PCT/ISA/210.
European Search Report dated Oct. 16, 2009.

* cited by examiner

3/9

ROCKER ARM

TECHNICAL FIELD

The present invention relates to a rocker arm for opening and closing a valve which is provided on a cylinder head of an engine of an automobile or the like, and more particularly, to the rocker arm formed of material in a shape of sheet.

BACKGROUND ART

The rocker arm serves for opening and closing a valve which is provided on a cylinder head of an engine of an automobile or the like, and has a pair of side wall portions opposed to each other, a connection portion for a valve stem receiving portion which interconnects inner side surfaces of the pair of side wall portions at one end in a longitudinal direction, a connection portion for a pivot receiving portion which interconnects inner side surfaces of the pair of side wall portions at the other end in the longitudinal direction, and an open portion for arranging a roller which is formed between the connection portion for the valve stem receiving portion and the connection portion for the pivot receiving portion. Specifically, the rocker arm has such a complicated three-dimensional shape that the pair of side wall portions and the connection portion for the valve stem receiving portion form a substantially H-shape in section, the pair of side wall portions and the connection portion for the pivot receiving portion form a substantially U-shape in section, and the pair of side wall portions interposing the open portion for arranging the roller form a substantially II-shape in section.

In this rocker arm, a valve stem of an engine comes into contact with the valve stem receiving portion which is formed in the connection portion for the valve stem receiving portion, a pivot of a lash adjuster of the engine comes into contact with the pivot receiving portion which is formed in the connection portion for the pivot receiving portion, and a cam of the engine slides along the roller which is rotatably provided in the open portion for arranging the roller.

Recently, for the purpose of complying with requests for energy saving, high speed rotation of the engine, and cost cutting, it has been endeavored to make the rocker arm lightweight and rigid, and to develop a new process for producing the rocker arm. The inventor and his group have successfully developed a production process in which the complicated three-dimensional shape as described above can be formed only by plastically deforming a piece of metal sheet, and a metal flow can be continued between the pair of side wall portions and the connection portion for the valve stem receiving portion (within the substantially H-shaped section), and have disclosed this process (Refer to Patent Document 1, for example).

Patent Document 1: Japanese Patent Publication No. JP-A-2004-25240 (Page 4, FIG. 8)

DISCLOSURE OF THE INVENTION

Problems That the Invention Is to Solve

In the invention disclosed in the above described patent document 1, the rocker arm is produced by plastically deforming a piece of metal sheet, and the metal flow is continued as described above. Therefore, the prior invention has achieved such remarkable effects that the production cost is low, and at the same time, weight reduction, high rigidity and stable quality of a product are assured. However, beyond this success, an invention for making the rocker arm further lightweight, compact, and highly rigid has been requested.

Specifically, because dimensions of the aforesaid roller are determined depending on a load imposed from the cam, and a width of the roller becomes larger in proportion with the load, it is necessary to set a large distance between the pair of aforesaid side wall portions for receiving the roller in the open portion. On the other hand, in the connection portion for the valve stem receiving portion, a width of the valve stem receiving portion must be set to be small, in case where the valve stem has a small diameter.

However, for the purpose of reducing the weight of the rocker arm, a distance between the roller and the valve stem receiving portion in the longitudinal direction tends to be set smaller. Therefore, there inevitably arises such necessity that the distance between the side wall portions of the rocker arm is abruptly varied within a short distance between the open portion for arranging the roller and the connection portion for the valve stem receiving portion.

Accordingly, it is necessary to set a larger amount of offset between the portion for arranging the roller and the connection portion for the valve stem receiving portion in the side wall portions, at a time of forming the rocker arm. For this reason, there is such a problem that a crack may occur on an outer surface or an edge of a curved portion which is largely offset, and working accuracy may be deteriorated. Under the circumstances, it has been desired to develop a structure and a production process in which the side wall portions of the rocker arm can be formed with a large amount of offset.

The invention has been made in view of this request, and it is an object of the invention to provide a rocker arm which can be made further lightweight, compact and highly rigid, while preventing occurrence of cracks and deterioration of working accuracy in stamping work.

Means for Solving the Problems (1) The rocker arm according to the invention is a rocker arm formed of material in a shape of sheet, which includes a pair of side wall portions opposed to each other, a connection portion for a valve stem receiving portion which interconnects inner side surfaces of the pair of side wall portions at one end thereof in a longitudinal direction, a connection portion for a pivot receiving portion which interconnects inner side surfaces of the pair of side wall portions at the other end thereof in the longitudinal direction, and an open portion for arranging a roller which is formed between the connection portion for the valve stem receiving portion and the connection portion for the pivot receiving portion, and characterized in that a distance between outer side surfaces of the pair of side wall portions in the connection portion for the valve stem receiving portion is reduced in a step-like shape or in a taper shape having two or more step differences.

(2) Moreover, the rocker arm is characterized in that a distance between inner side surfaces of the pair of side wall portions in the connection portion for the valve stem receiving portion is increased in a step-like shape having one or more step differences in a direction from the connection portion for the valve stem receiving portion to lower edges of the side wall portions.

(3) Further, the rocker arm is characterized in that an amount of offset which is a distance in a direction of thickness of the side wall portions between the outer side surfaces of the pair of side wall portions in the connection portion for the valve stem receiving portion and outer side surfaces of the side wall portions in the open portion for arranging the roller is 0.2 to 2.0 times as large as a sheet thickness of the material.

(4) Still further, the rocker arm is characterized in that a support shaft is provided on the pair of side wall portions at a position corresponding to the open portion for arranging the roller, and the roller is rotatably arranged on the support shaft by means of a needle roller.

ADVANTAGE OF THE INVENTION

As the results, the rocker arm according to the invention achieves the following effects.

(i) Because the distance between the outer side surfaces of the pair of side wall portions in the connection portion for the valve stem receiving portion is reduced in a step-like shape or in a taper shape having two or more step differences in a direction from the upper edges to the lower edges of the side wall portions, or from the open portion for arranging the roller to the one end in the longitudinal direction of the connection portion for the valve stem receiving portion, it is possible to make the rocker arm lightweight, compact, and highly rigid.

(ii) Because the distance between the inner side surfaces of the pair of side wall portions in the connection portion for the valve stem receiving portion is increased in a step-like shape having two or more step differences in a direction from the connection portion for the valve stem receiving portion to the lower edges of the side wall portions, in other words, both the outer side surfaces and the inner side surfaces of the side wall portions approach in a step-like shape toward the lower edges, it is possible to further make the rocker arm lightweight, compact and highly rigid, while maintaining high rigidity and high working accuracy.

(iii) Because the amount of offset is 0.2 to 2.0 times as large as the sheet thickness of the material, occurrence of a crack in stamping work can be prevented, and plastic deformation having a continuous metal flow can be performed. Therefore, it is possible to restrain an increase of the production cost, while high rigidity and high working accuracy are attained.

(iv) Further, because the roller is rotatably arranged by means of the needle roller, it is possible to promote followability to high speed, low vibration (low noise), and long life of the rocker arm, while the rocker arm is made lightweight, compact and highly rigid.

BEST MODE FOR CARRYING OUT THE INVENTION

Embodiment 1

Figure 1A:
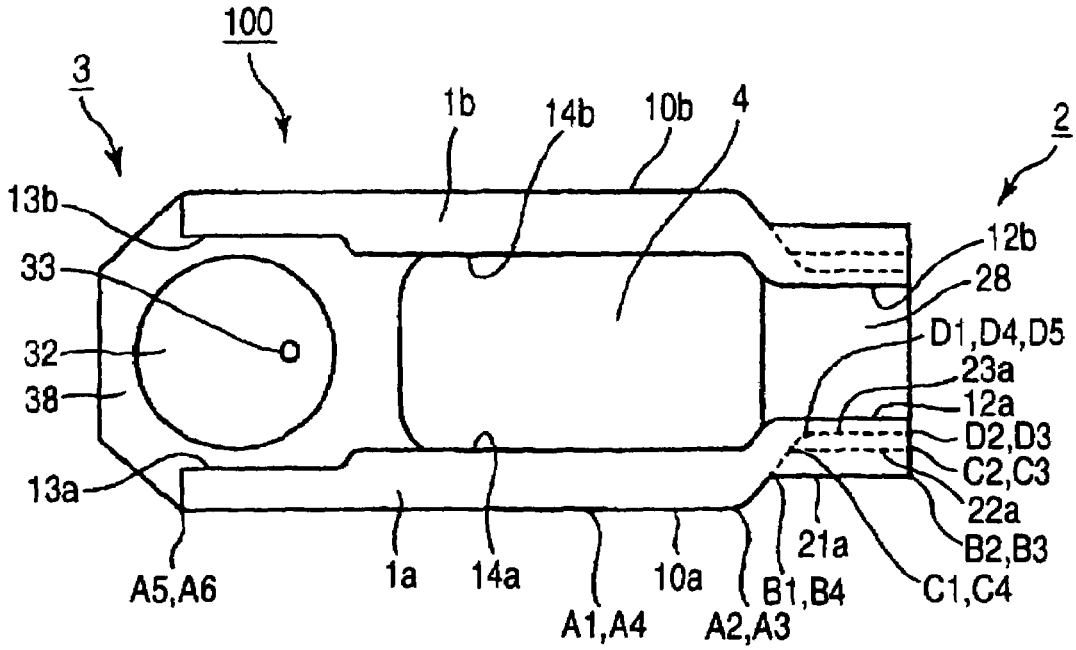
FIG. 1A is a plan view schematically showing a rocker arm in an embodiment 1 according to the invention.
Figure 1B:
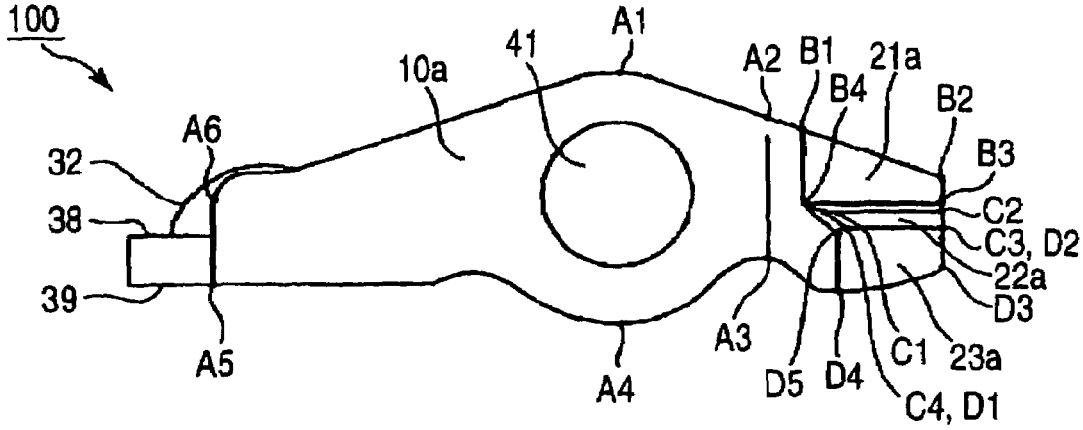
FIG. 1B is a front view schematically showing the rocker arm in the embodiment 1 according to the invention.
Figure 1C:
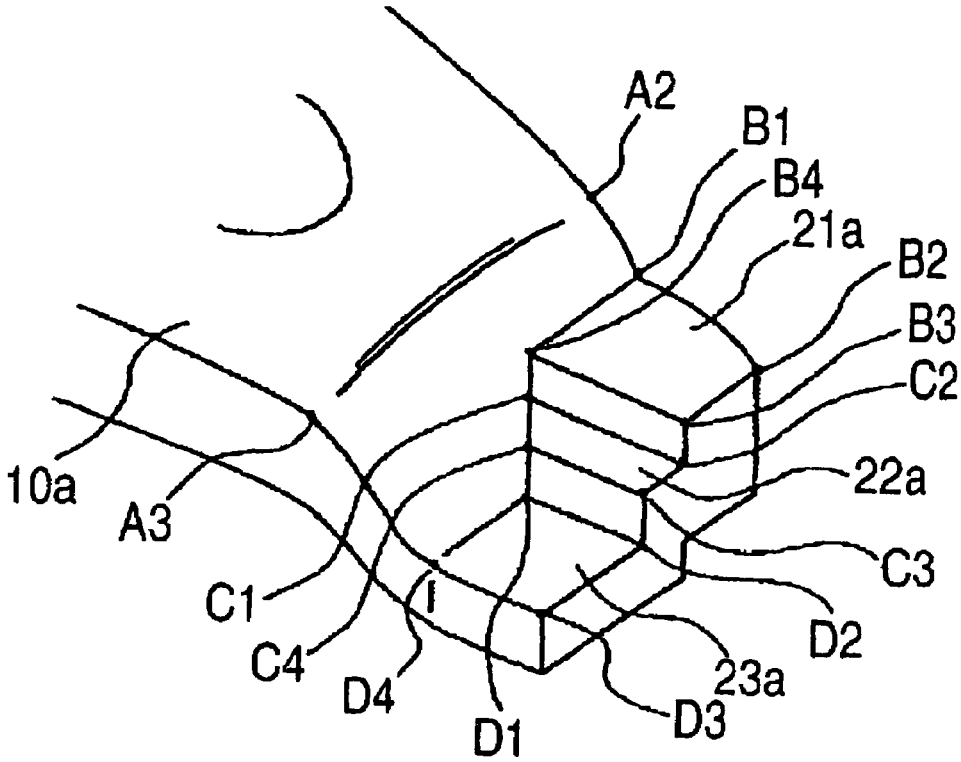
FIG. 1C is a perspective view schematically showing the rocker arm in the embodiment 1 according to the invention.
Figure 2A:
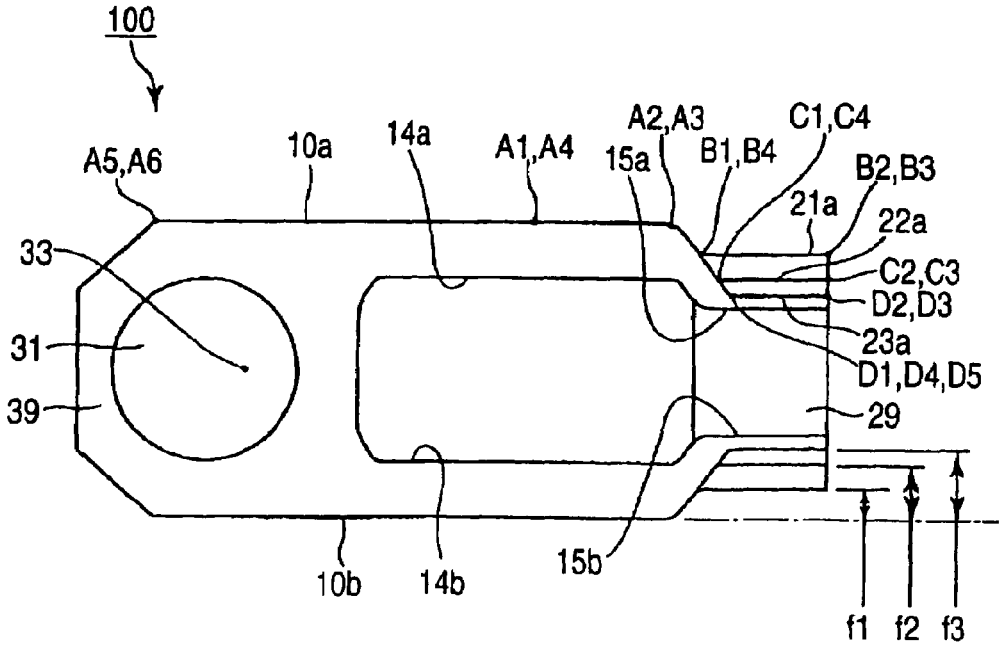
FIG. 2A is a bottom view schematically showing the rocker arm in the embodiment 1 according to the invention.
Figure 2B:
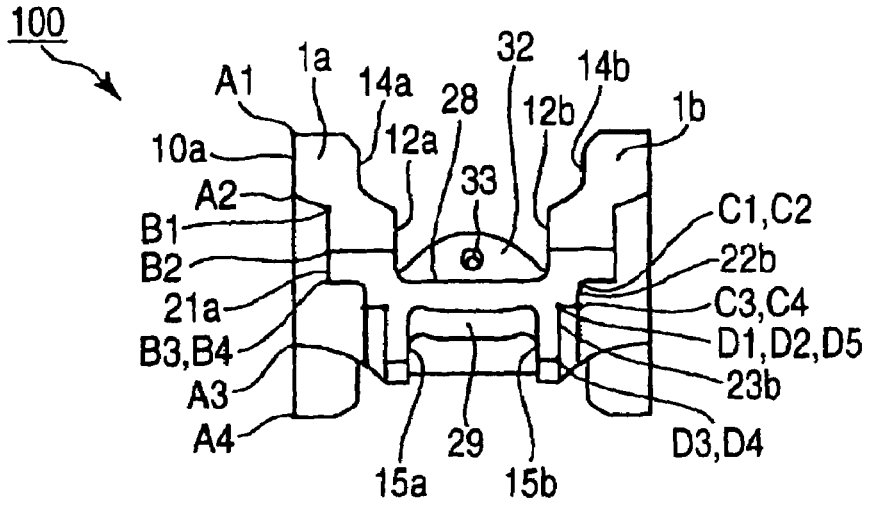
FIG. 2B is a right side view schematically showing the rocker arm in the embodiment 1 according to the invention.

FIGS. 1A to 2B schematically show the rocker arm in the embodiment 1 according to the invention. FIG. 1A is a plan view, FIG. 1B is a front view, FIG. 1C is a perspective view, FIG. 2A is a bottom view, and FIG. 2B is a right side view.

In FIGS. 1A to 2B, a rocker arm 100 has a pair of side wall portions 1*a*, 1*b* opposed to each other, a connection portion 2 for a valve stem receiving portion which interconnects inner side surfaces 12*a*, 12*b* at one end in a longitudinal direction (at a right side in a horizontal direction, in the drawings) of the side wall portions 1*a*, 1*b*, a connection portion 3 for a pivot receiving portion which interconnects inner side surfaces 13*a*, 13*b* at the other end in the longitudinal direction (at a left side in the horizontal direction, in the drawings) of the side wall portions 1*a*, 1*b*, and an open portion 4 for arranging a roller which is the open portion interposed between inner side surfaces 14*a*, 14*b* at a substantially center of the side wall portions 1*a*, 1*b* in the longitudinal direction and formed between the connection portion 2 for the valve stem receiving portion and the connection portion 3 for the pivot receiving portion. It is to be noted that only one side of the rocker arm 100 will be described in some cases in the following description, omitting affixes "a, b" concerning contents which are common to both sides, because the rocker arm 100 is symmetrical with respect to a plane which is parallel to the longitudinal direction, in a plan view.

(The Connection Portion for the Valve Stem Receiving Part)

An outer side surface of the side wall portion 1 at a position corresponding to the connection portion 3 for the pivot receiving portion and the open portion 4 for arranging the roller, that is, a region defined by "A1-A2-A3-A4-A5-A6-A1" in the drawings forms a substantially same plane (hereinafter referred to as "an outer side surface 10 of a main body).

On the other hand, an outer side surface of the side wall portion 1 at a position corresponding to the connection portion 2 for the valve stem receiving portion is formed in a step-like shape, having a first outer side surface 21 (defined by "B1-B2-B3-B4-B1" in the drawings), a second outer side surface 22 (defined by "C1-C2-C3-C4-C1" in the drawings), and a third outer side surface 23 (defined by "D1-D2-D3-D4-

D1" in the drawings), substantially in parallel in a direction from the outer side surface 10 of the main body to the connection portion 2 for the valve stem receiving portion.

Moreover, a substantially horizontal surface "B4-B3-C2-C1-B4" is formed between the first outer side surface 21 and the second outer side surface 22, and a substantially horizontal surface "C4-C3-D2-D1-C4" is formed between the second outer side surface 22 and the third outer side surface 23. Further, curved surfaces are formed between respective longitudinal directions of the outer side surface 10 of the main body, the first outer side surface 21, the second outer side surface 22, and the third outer side surface 23.

In FIG. 1B, the substantially horizontal surface "B4-B3-C2-C1-B4" is schematically shown by a double line. However, it is to be noted that the respective surfaces including this substantially horizontal surface are connected by means of fillets having a determined radius and so, those lines which define the respective surfaces are not exactly seen.

In this case, a distance f1 in a direction of thickness of the side wall portion 1 (referred to as a vertical direction in FIGS. 1A and 2A, or an axial direction in some cases, hereinafter) between the outer side surface 10 of the main body and the first outer side surface 21 is referred to as "a first offset", a distance f2 in the axial direction between the outer side surface 10 of the main body and the second outer side surface 22 is referred to as "a second offset", and a distance f3 in the axial direction between the outer side surface 10 of the main body and the third outer side surface 23 is referred to as "a third offset".

A distance between the inner side surfaces 12*a*, 12*b* at the one end is set to be smaller in a region above the connection portion 2 for the valve stem receiving portion than in a region below the connection portion 2. In the following description, the inner side surfaces in the region above the connection portion 2 for the valve stem receiving portion are referred to as the inner side surfaces 12*a*, 12*b*, and the inner side surfaces in the region below the connection portion 2 are referred to as "first inner side surfaces 15*a*, 15*b*" for convenience's sake.

The connection portion 2 for the valve stem receiving portion is so shaped that its upper surface 28 is substantially flat and its lower surface 29 has a shape similar to a portion of a cylinder or a barrel. Therefore, a valve stem of an engine of an automobile or the like, which is not shown, is inserted between the first inner side surfaces 15*a*, 15*b* having the smaller distance therebetween, and a distal end of the valve stem is brought into contact with the lower surface 29.

As described above, the side wall portion 1 of the connection portion 2 for the valve stem receiving portion is formed in a step-like shape having the respective steps smoothly continued. Accordingly, even in case where the side wall portion 1 is formed by plastically deforming material in a shape of sheet, cracks will not occur in corner portions, and a metal flow will not be interrupted (See Patent Document 1 in this respect). As the results, the rocker arm which has high rigidity, light weight, and high durability can be obtained.

The first offset f1, the second offset f2 or the third offset f3 are preferably 0.2 to 2.0 times as large as a thickness of the sheet as the material. However, the invention is not limited to the case, but the offsets may be 2.0 to 3.0 times as large as the thickness of the sheet, in case where quality of the material is varied, or the material has a hardness below 200 HB by annealing the material during the stamping process, or application process of lubricant is added.

(The Connection Portion for the Pivot Receiving Part)

The connection portion 3 for the pivot receiving portion has a concave portion 31 similar to a portion of a substantially spherical shape which is formed on its lower surface 39, and a pivot of a lash adjuster of the engine, which is not shown, slides along the concave portion 31 (hereinafter, an inner surface of the concave portion 31 is referred to as "a pivot receiving portion 31"). In addition, a convex portion 32 similar to a portion of a spherical shape is formed on an upper surface 38 of the connection portion 3 for the pivot receiving portion in correspondence with the pivot receiving portion 31. Moreover, a through hole 33 communicating the pivot receiving portion 31 to an outer surface of the convex portion 32 is formed. The through hole 33 serves to supply lubricating oil to the pivot receiving portion 31, but this may be omitted.

As seen in FIG. 1A, a distance between the inner side surfaces 13*a*, 13*b* at the other end in the longitudinal direction is larger than a distance between the inner side surfaces 14*a*, 14*b* at a center in the longitudinal direction, which enables the pivot receiving portion 31 to be easily formed, and makes the rocker arm lightweight, in correspondence with a reduced wall thickness of the side wall portion 1.

(The Open Portion for Arranging the Roller)

A through hole 41 for mounting a support shaft, which is not shown, is formed through the side wall portion 1 at a position corresponding to the open portion 4 for arranging the roller. Accordingly, it is possible to install the roller by arranging a needle roller around the support shaft which is mounted in the through hole 41. As the results, sliding resistance of a cam which is in contact with the roller is decreased, and hence, smooth operation of the valve and improvement in fuel economy can be achieved.

In place of the though hole 41, a recess having a round shape in section for mounting the support shaft may be formed on the inner side surface.

Embodiment 2

Figure 3A:
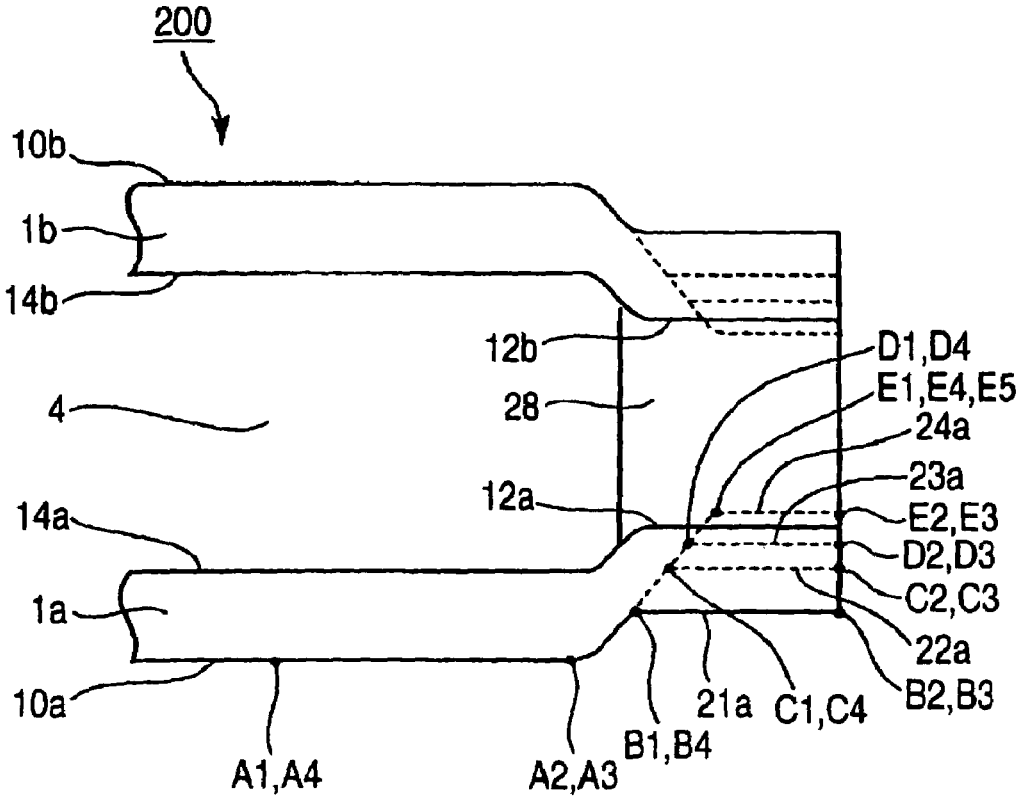
FIG. 3A is a plan view schematically showing a rocker arm in an embodiment 2 according to the invention.
Figure 3B:
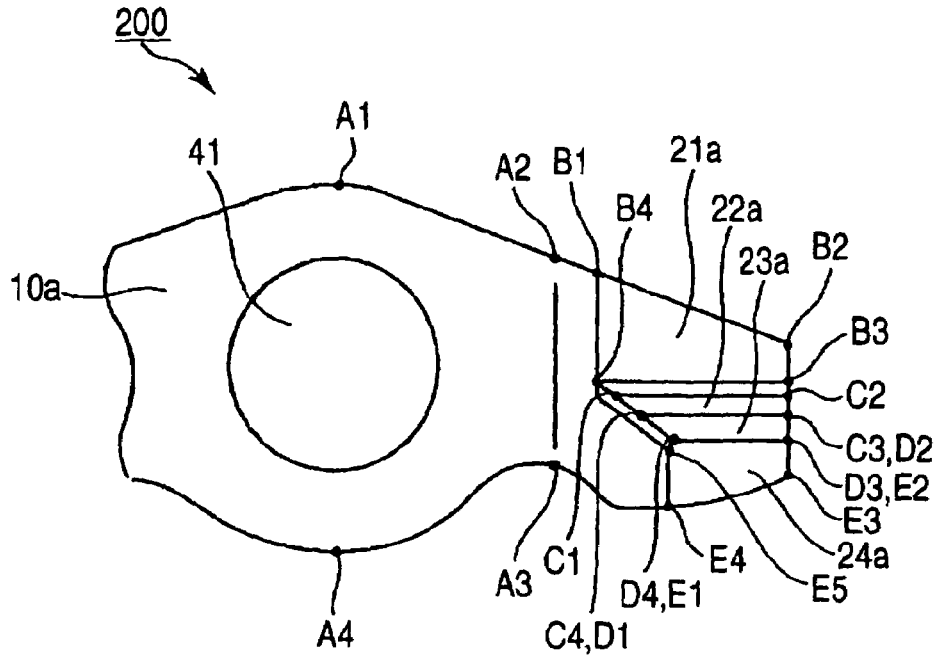
FIG. 3B is a front view schematically showing the rocker arm in the embodiment 2 according to the invention.
Figure 4A:
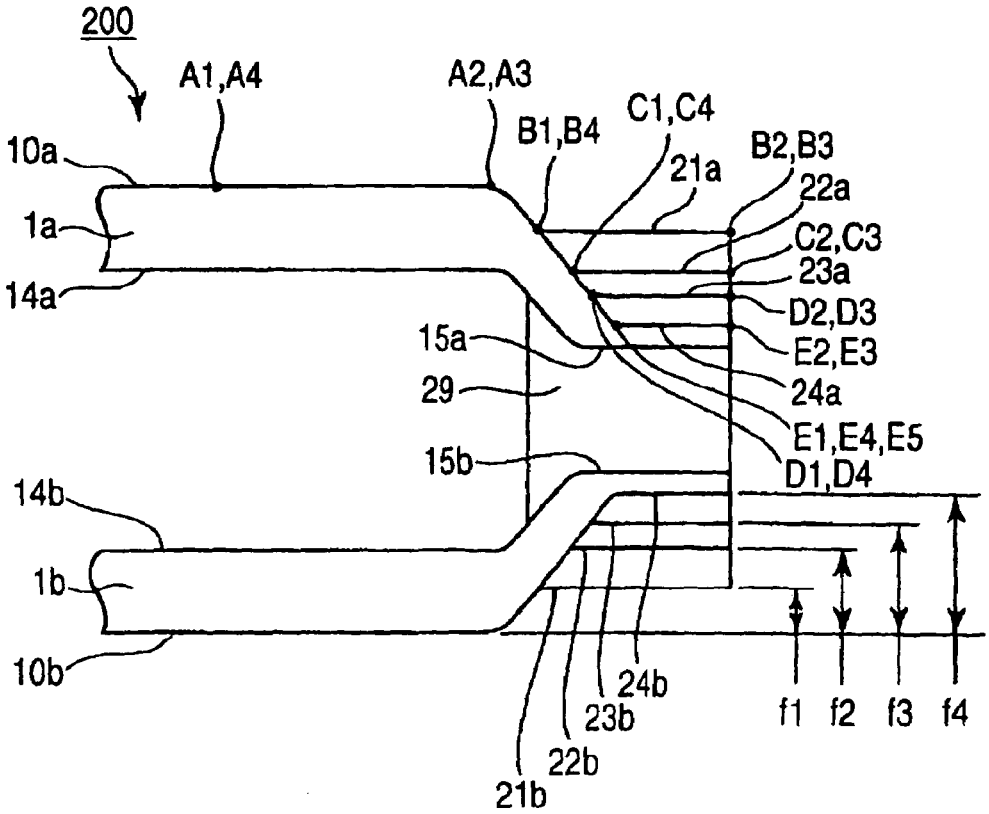
FIG. 4A is a bottom view schematically showing the rocker arm in the embodiment 2 according to the invention.
Figure 4B:
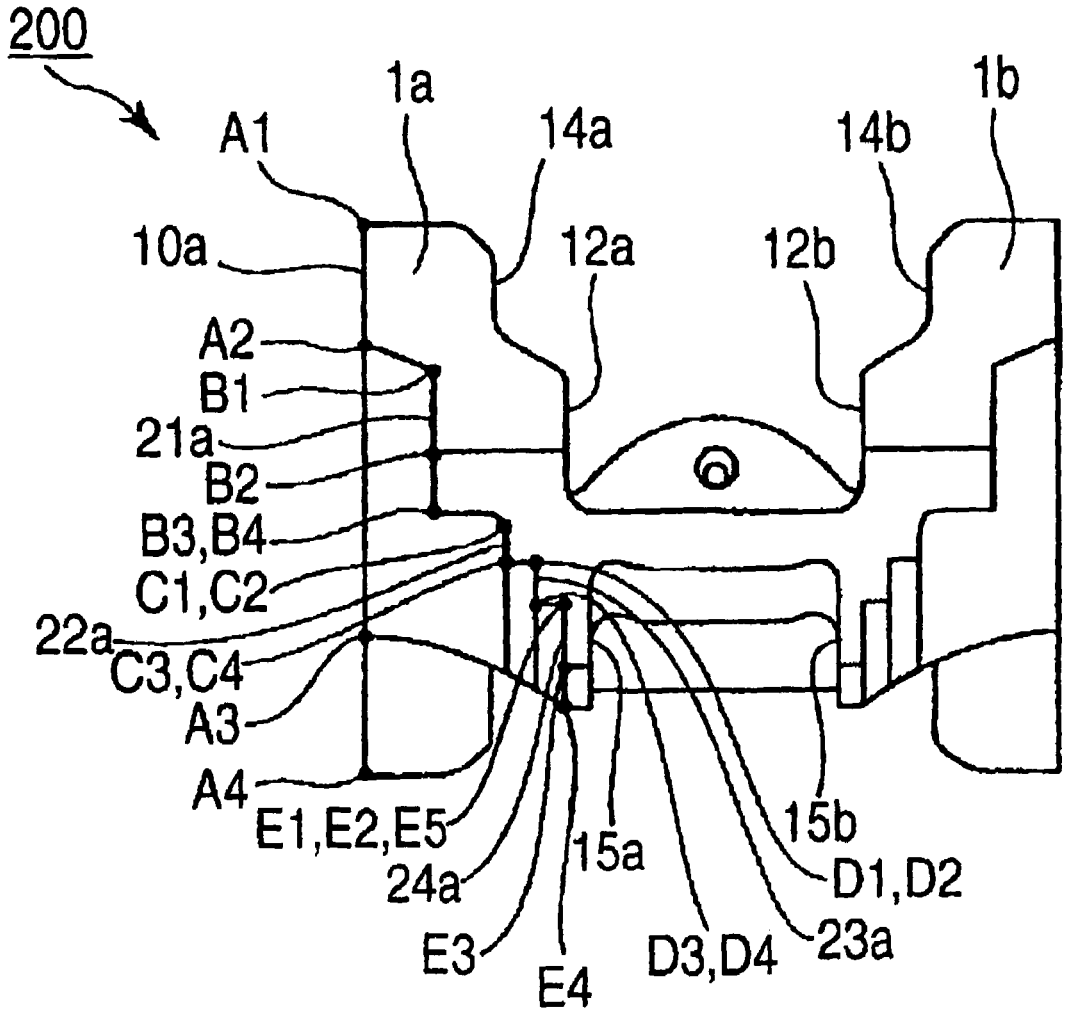
FIG. 4B is a right side view schematically showing the rocker arm in the embodiment 2 according to the invention.

FIGS. 3A to 4B are enlarged views schematically showing a portion of a rocker arm in an embodiment 2 according to the invention. FIG. 3A is a plan view, FIG. 3B is a front view, FIG. 4A is a bottom view, and FIG. 4B is a right side view. The portions which are the same as those portions in the embodiment 1 (FIGS. 1A to 2B) will be denoted with the same reference numerals, and a portion of the description will be omitted.

In FIGS. 3A through 4B, in addition to the first outer side surface 21, the second outer side surface 22, and the third outer side surface 23, a fourth outer side surface 24 (defined by "E1-E2-E3-E4-E5-E1" in the drawings) is formed in a step-like shape on the outer side surface of the side wall portion 1 at a position corresponding to the connection portion 2 for the valve stem receiving portion in a rocker arm 200, at a position of a distance f4 from the outer side surface 10 of the main body in the axial direction (corresponding to a fourth offset).

As the results, the rocker arm 200 can be made more lightweight than the rocker arm 100 in the embodiment 1. In this case, the respective surfaces are formed in a step-like shape having the substantially horizontal surfaces, as described above. Therefore, accuracy in size is assured and the metal flow is continued. In this invention, the number of steps is not limited to four or less, but more than five steps may be formed.

Embodiment 3

Figure 5A:
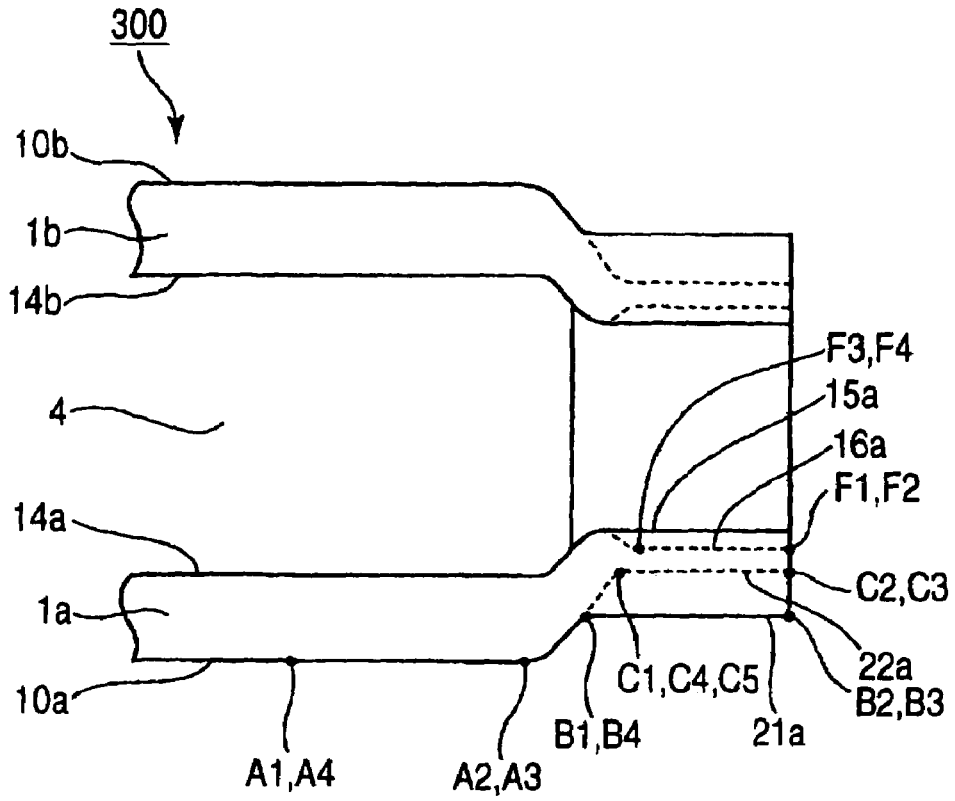
FIG. 5A is a plan view schematically showing a rocker arm in an embodiment 3 according to the invention.
Figure 5B:
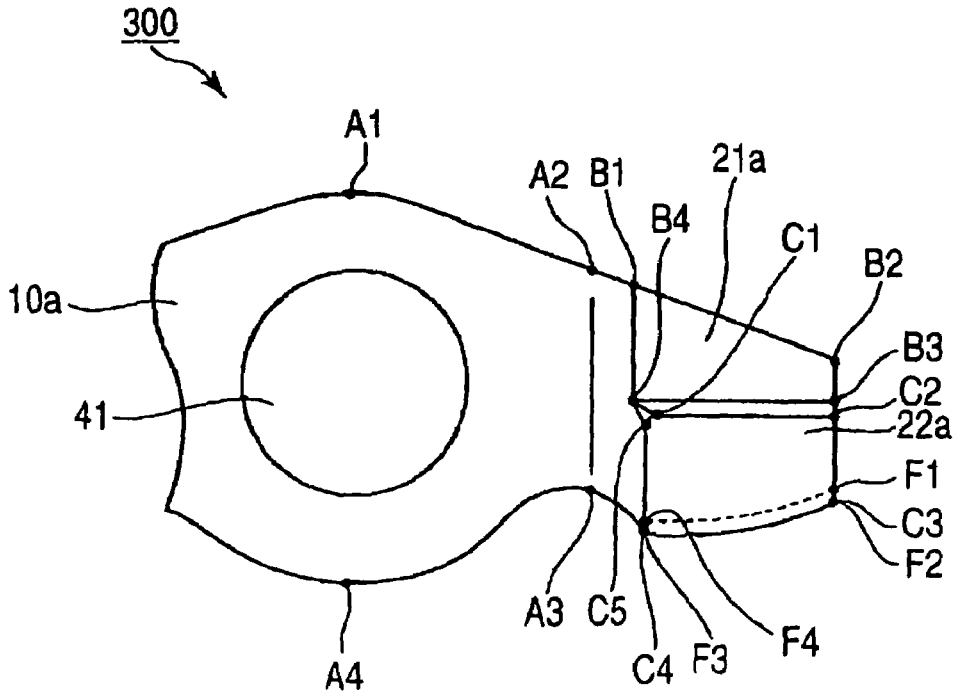
FIG. 5B is a front view schematically showing the rocker arm in the embodiment 3 according to the invention.
Figure 6A:
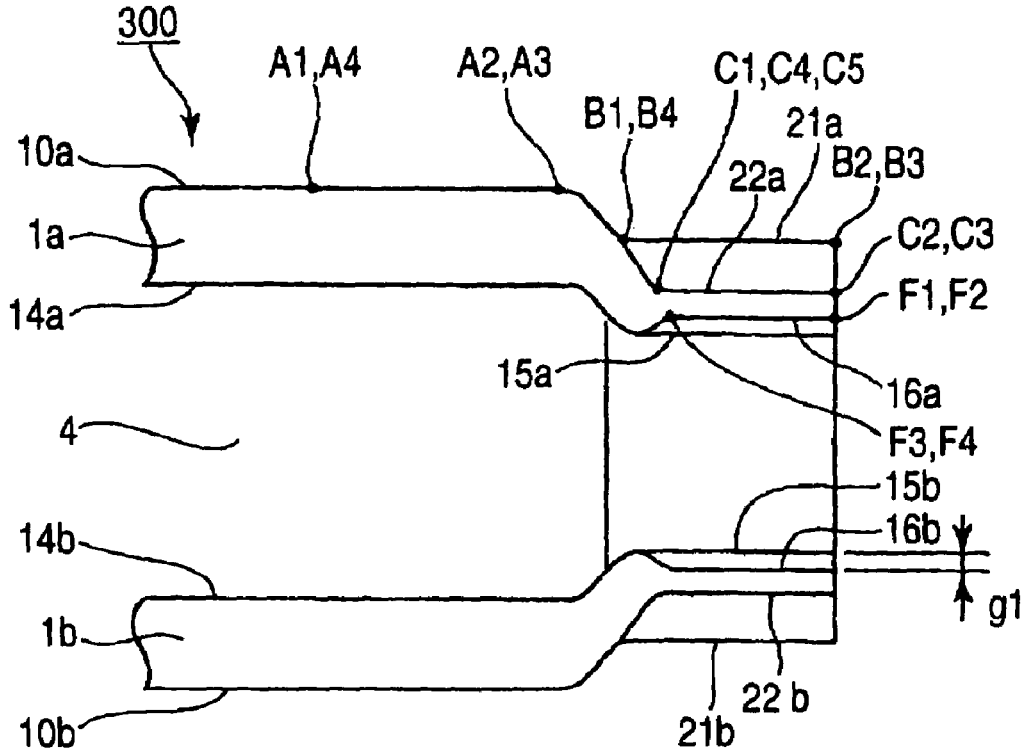
FIG. 6A is a bottom view schematically showing the rocker arm in the embodiment 3 according to the invention.
Figure 6B:
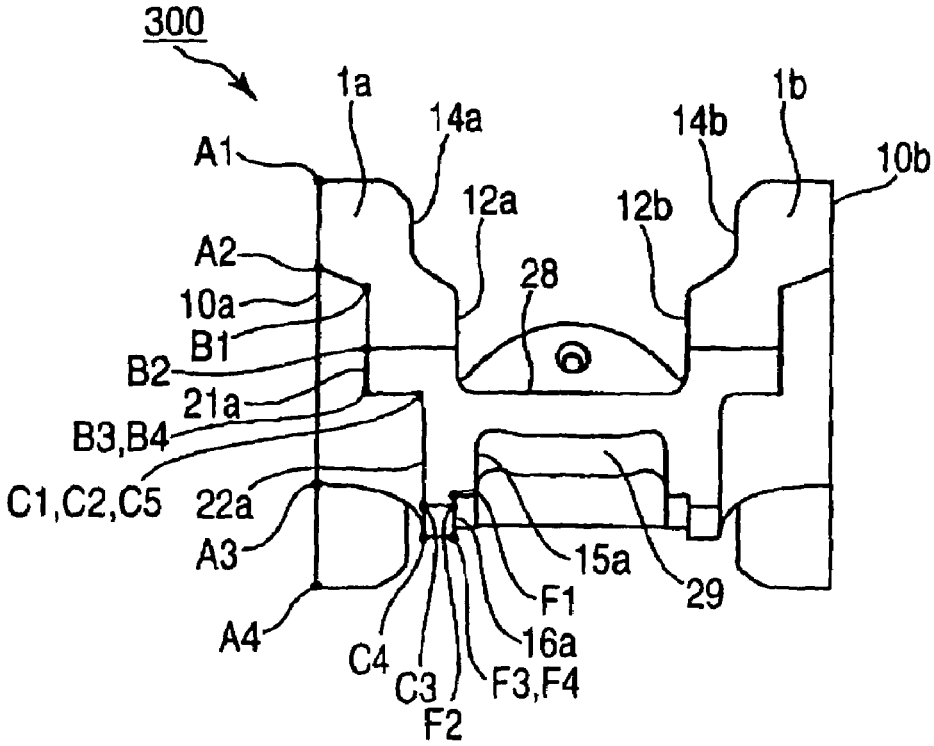
FIG. 6B is a right side view schematically showing the rocker arm in the embodiment 3 according to the invention.

FIGS. 5A to 6B are enlarged views schematically showing a portion of a rocker arm in an embodiment 3 according to the invention. FIG. 5A is a plan view, FIG. 5B is a front view, FIG. 6A is a bottom view, and FIG. 6B is a right side view. The portions which are the same as those portions in the embodiment 1 (FIGS. 1A to 2B) will be denoted with the same reference numerals, and a portion of the description will be omitted.

In FIGS. 5A to 6B, the first outer side surface 21 and the second outer side surface 22 are formed on the outer side surface of the side wall portion 1 at a position corresponding to the connection portion 2 for the valve stem receiving portion in a rocker arm 300. On the other hand, a second inner side surface 16 (a region defined by "F1-F2-F3-F4-F1" in the drawings) is formed on the first inner side surface 15 which is an inside of the second outer side surface 22, along a lower edge thereof.

A distance g1 (equal to a step difference) between the first inner side surface 15 and the second inner side surface 16 in the axial direction can be appropriately selected. It is also possible to form a third inner side surface and so on (not shown) in conformity with the outer side surface. Further, in conformity with the embodiments 1 and 2, three or more step differences may be provided on the outer side surface.

Other Embodiments

Figure 7A:
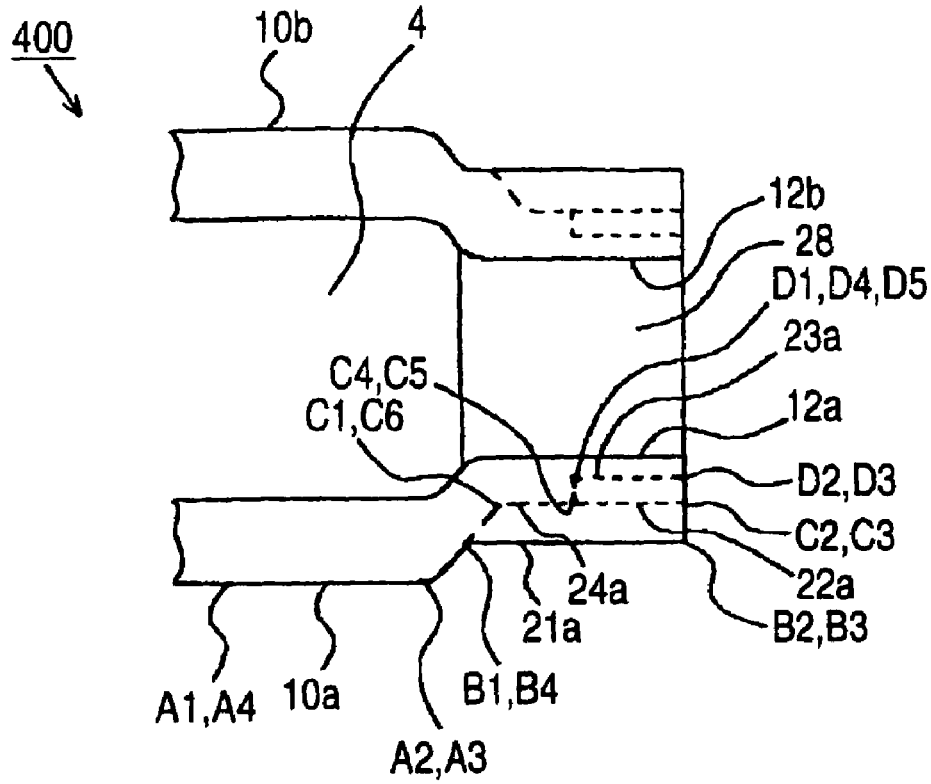
FIG. 7A is a plan view schematically showing a rocker arm in another embodiment according to the invention.
Figure 7B:
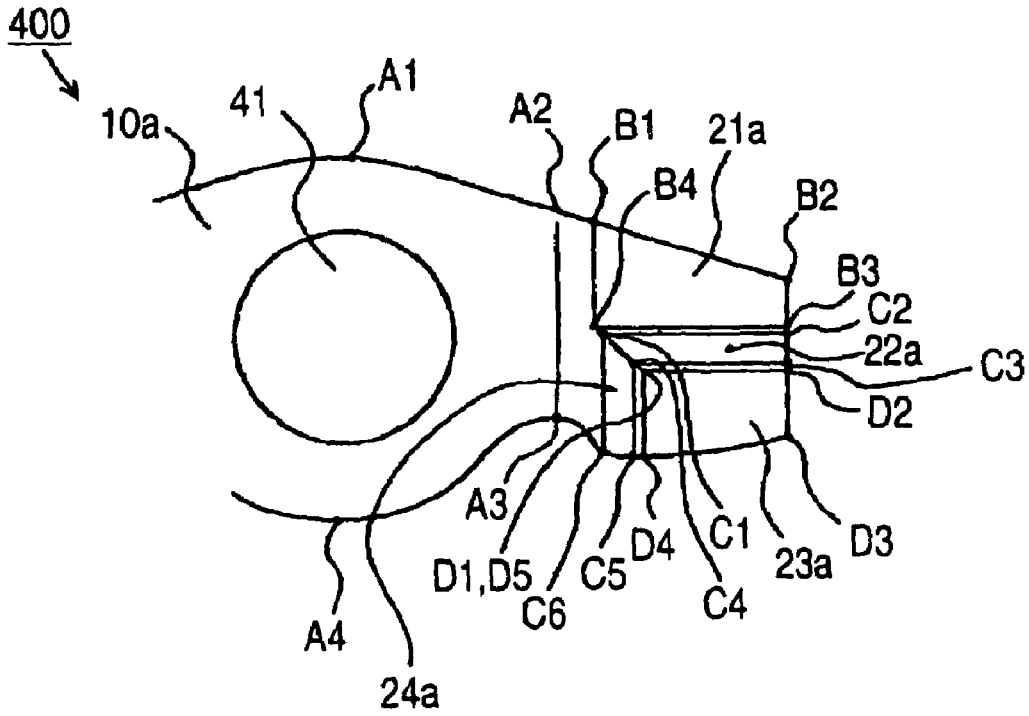
FIG. 7B is a front view schematically showing the rocker arm in the other embodiment according to the invention.
Figure 7C:
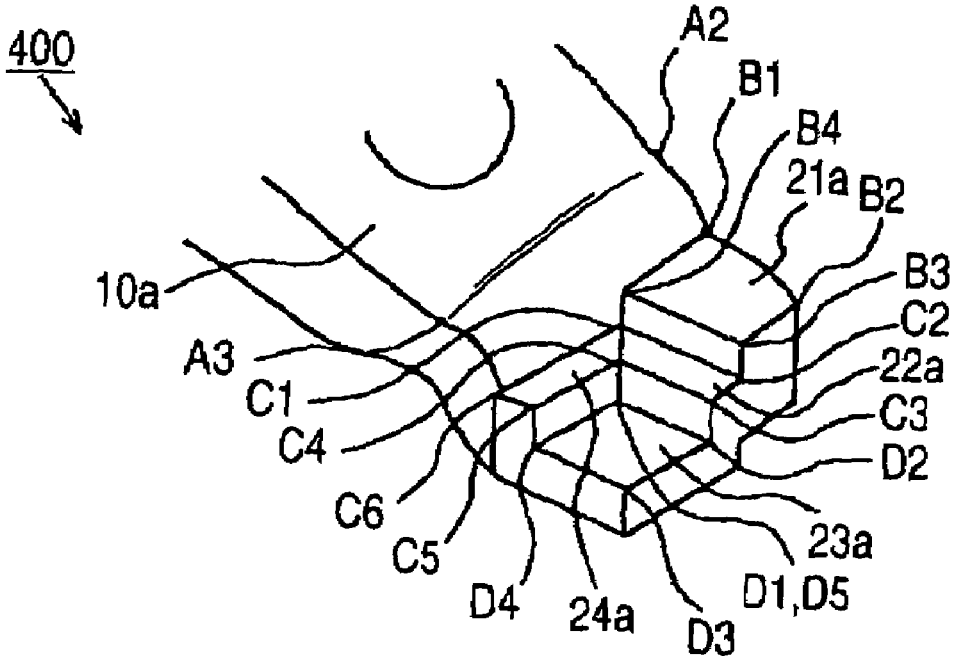
FIG. 7C is a perspective view schematically showing the rocker arm in the other embodiment according to the invention.
Figure 8A:
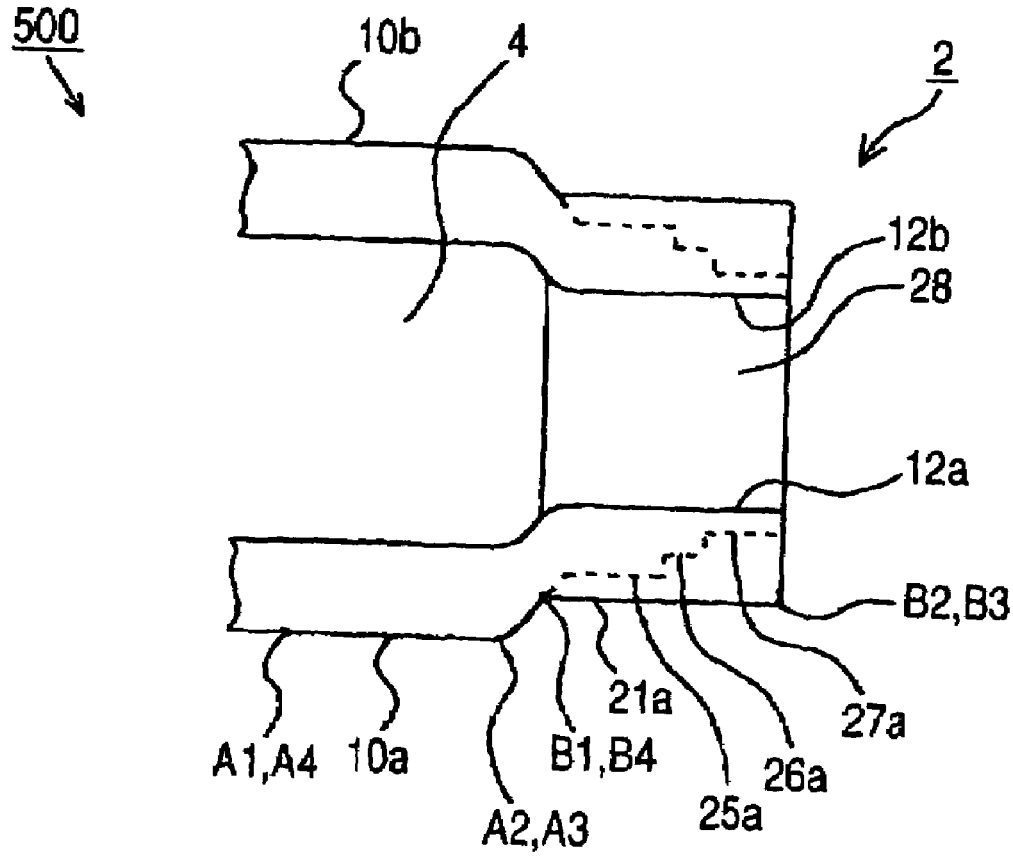
FIG. 8A is a plan view schematically showing the rocker arm in still another embodiment according to the invention.
Figure 8B:
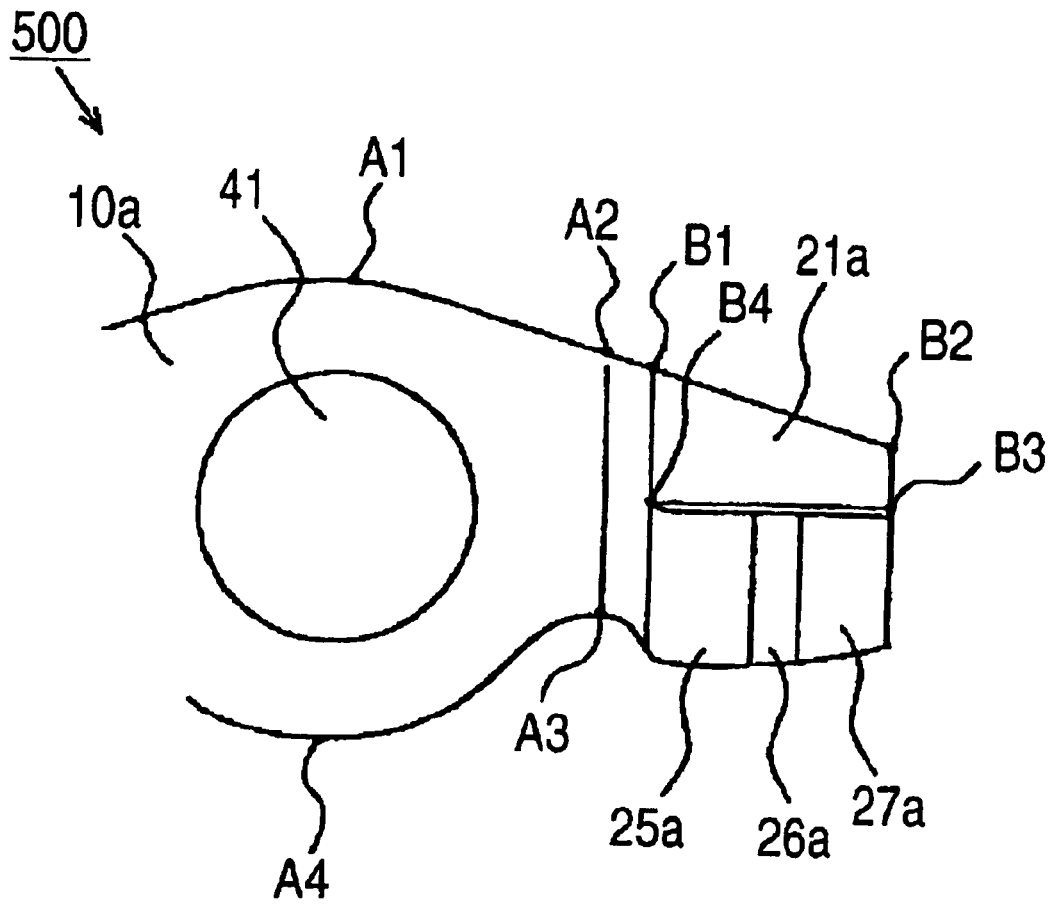
FIG. 8B is a front view schematically showing the rocker arm in the other embodiment according to the invention.
Figure 8C:
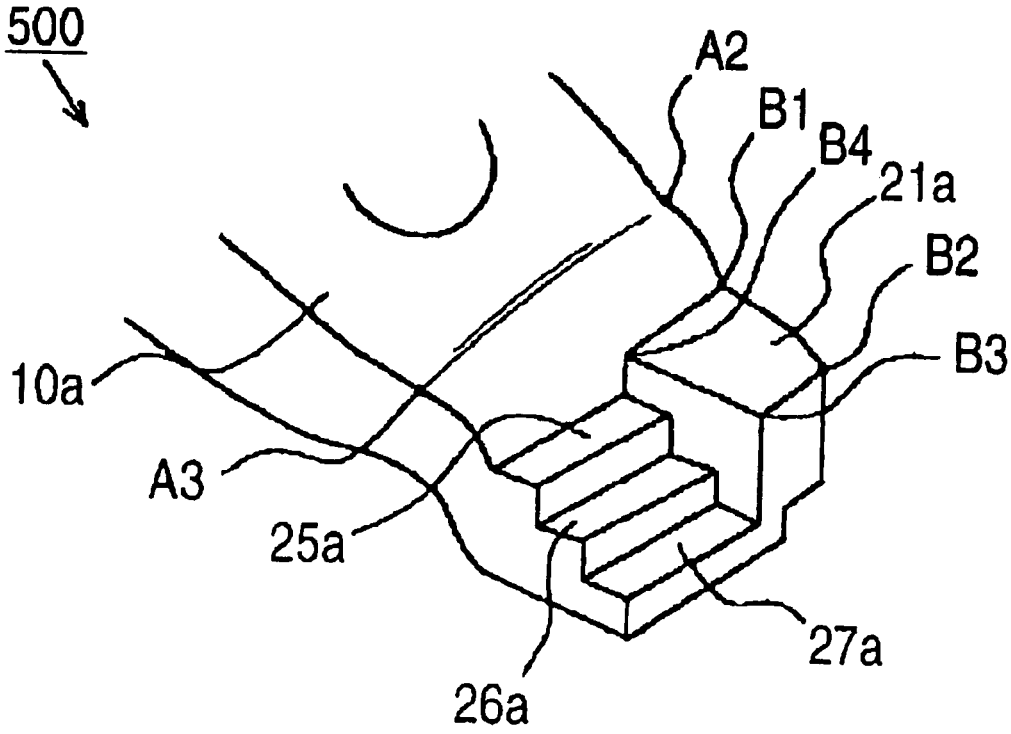
FIG. 8C is a perspective view schematically showing the rocker arm in the other embodiment according to the invention.

FIGS. 7A to 8C schematically show a portion of rocker arms in other embodiments according to the invention. FIGS. 7A and 8A are plan views, FIGS. 7B and 8B are front views, and FIGS. 7C and 8C are perspective views. The portions which are the same as those portions in the embodiment 1 (FIGS. 1A to FIG. 2B) will be denoted with the same reference numerals, and a portion of the description will be omitted.

In FIGS. 7A to 7C, the first outer side surface 21, the second outer side surface 22, and the third outer side surface 23 are formed on the outer side surface of the side wall portion 1 at a position corresponding to the connection portion 2 for the valve stem receiving portion in a rocker arm 400. Further, a fourth outer side surface 24 (a region defined by "C1-C4-C5-C6-C1" in the drawings) is formed in a vertical direction on the second outer side surface 22 at a position adjacent to the open portion 4 for arranging the roller. In short, the second outer side surface 22 and the fourth outer side surface 24 are connected in a substantially L-shape to form a substantially flat surface (a region defined by "C1-C2-C3-C4-C5-C6-C1" in the drawings).

In FIGS. 8A to 8C, in place of the second outer side surface 22 having a step-like shape in the vertical direction in the embodiments 1 to 3, a fifth outer side surface 25, a sixth outer side surface 26, and a seventh outer side surface 27 each having a step-like shape in the longitudinal direction are formed on the outer side surface of the side wall portion 1 at a position corresponding to the connection portion 2 for the valve stem receiving portion in a rocker arm 500.

Figure 9:
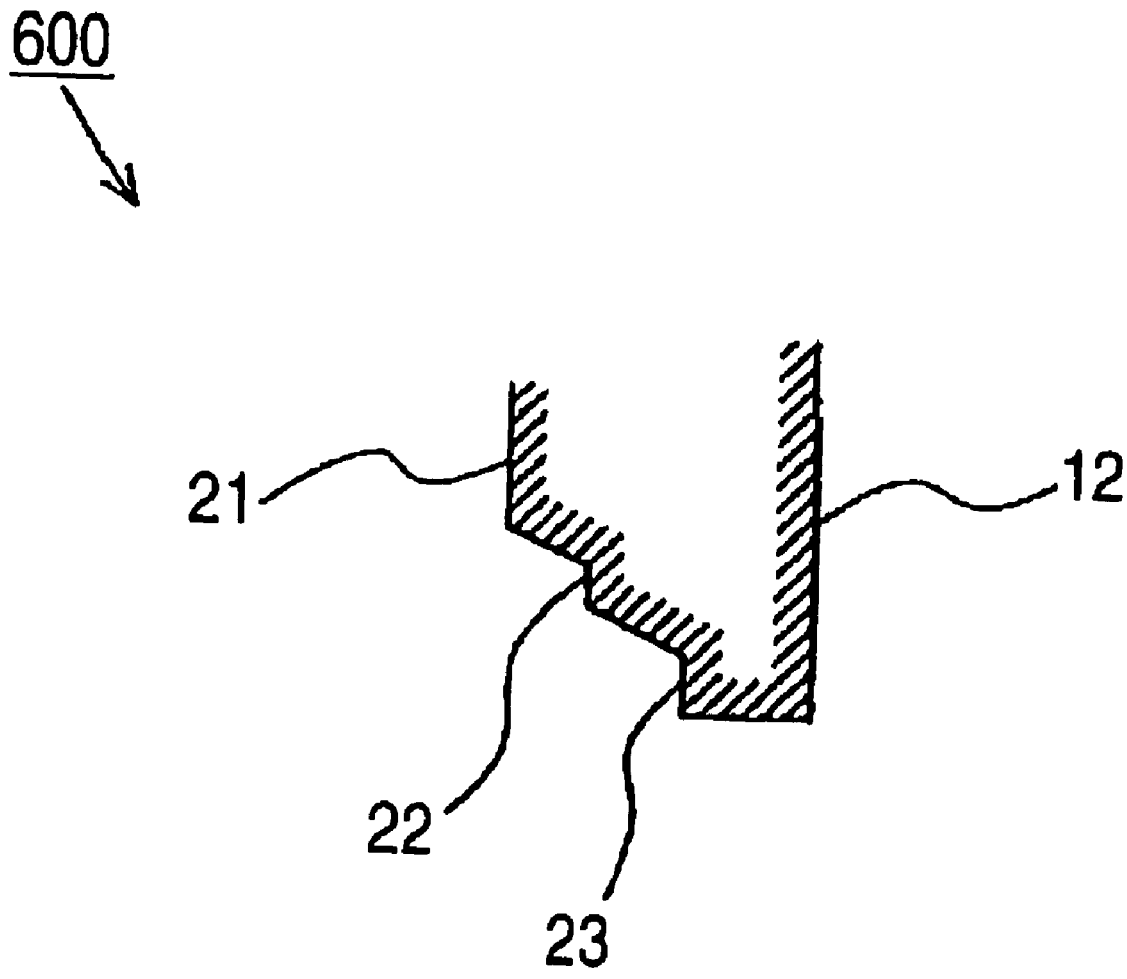
FIG. 9 is a side view showing a stepped portion of the rocker arm in still another embodiment according to the invention.

FIG. 9 is a side view showing a region having step differences in a rocker arm in another embodiment according to the invention. In FIG. 9, in a rocker arm 600, a stepped surface between the first outer side surface 21 and the second outer side surface 22, and a stepped surface between the second outer side surface 22 and the third outer side surface 23 in the above described rocker arm 100 (See FIGS. 1A to 1C) are not formed in a step-like shape which is parallel to the axial direction (substantially perpendicular to the outer side surface), but inclined in a taper shape.

In case where the stepped surfaces are formed in a step-like shape, weight reduction is more likely to be attained, but stamping work becomes difficult depending on the amount of the offset. On the other hand, in case where the stepped surfaces are tapered, the stamping work becomes easier, although the weight increases as compared with the case of the step-like shape. Therefore, the shape of the rocker arm may be selected considering these conditions. It is also possible to make the stepped surfaces tapered in the above described rocker arms 200 to 500, in the same manner as in the rocker arm 600.

Still further, from a view point of production process of a main body portion (body) of the rocker arm, the invention is characterized in that the wall thickness of the side wall portions in the connection portion for the valve stem receiving portion is sequentially reduced in a step-like shape, but the production process is not limited in the invention. For example, as a mold for the stamping work, a mold in a step-like shape in conformity with the step-like shape of the side wall portions may be used. Alternatively, production process for forming the stepped portion by sequentially using one or a plurality of molds may be employed, although working stages are increased in this case.

As described above, according to the invention, the outer side surfaces and the inner side surfaces of the side wall portion 1 in the connection portion 2 for the valve stem receiving portion are formed in a step-like shape or in a taper shape having the step differences, and all the steps are smoothly connected. Therefore, even in case where the rocker arm has been formed by plastically deforming the material in a shape of sheet, cracks will not occur in the corner portions, and the metal flow will not be interrupted (See Patent Document 1 in this respect). As the results, the rocker arm having high rigidity, lightweight, and high durability can be obtained.

INDUSTRIAL APPLICABILITY

As described above, the rocker arm according to the invention is formed by plastically deforming the material in a shape of sheet, and one side thereof in the longitudinal direction is formed narrow in width having a step-like shape. Therefore, this rocker arm can be widely utilized as the rocker arm which is lightweight and compact, while high rigidity is required.

The invention claimed is:

1. A rocker arm formed of a sheet material, comprising:

a pair of side wall portions opposed to each other;

a connection portion for a valve stem receiving portion, which interconnects a plurality of inner side surfaces of the pair of side wall portions at one end thereof in a longitudinal direction;

a connection portion for a pivot receiving portion, which interconnects the inner side surfaces of the pair of side wall portions at the other end thereof in the longitudinal direction; and an open portion for arranging a roller, which is formed between the connection portion for the valve stem receiving portion and the connection portion for the pivot receiving portion, wherein a distance between a plurality of outer side surfaces of the pair of side wall portions in the connection portion for the valve stem receiving portion is reduced in a step shape or in a taper shape comprising two or more step differences.

2. The rocker arm according to claim 1, wherein a distance between inner side surfaces of the pair of side wall portions in the connection portion for the valve stem receiving portion is increased in a step shape comprising one or more step differences in a direction from the connection portion for the valve stem receiving portion to a plurality of lower edges of the side wall portions.

3. The rocker arm according to claim 2, wherein the step shape or the taper shape of the inner side surfaces of the pair of side wall portions in the connection portion for the valve stem receiving portion is disposed on a side opposite a valve contact surface of a connection portion for the valve stem receiving portion.

4. The rocker arm according to claim 2, wherein the step shape or the taper shape of the inner side surfaces of the pair of side wall portions in the connection portion for the valve stem receiving portion is disposed on both a side opposite a valve contact surface of the connection portion for the valve stem receiving portion and a side including the valve contact surface of the connection portion for the valve stem receiving portion.

5. The rocker arm according to claim 1, wherein an amount of offset, which is a distance in a direction of thickness of the side wall portions between the outer side surfaces of the pair of side wall portions in the connection portion for the valve stem receiving portion and outer side surfaces of the pair of side wall portions in the open portion for arranging the roller, is 0.2 to 2.0 times as large as a sheet thickness of the material.

6. The rocker arm according to claim 1, wherein a support shaft is mounted on the pair of side wall portions at a position corresponding to the open portion for arranging the roller, and the roller is rotatably disposed on the support shaft through a needle roller.

7. The rocker arm according to claim 1, wherein the step shape or the taper shape includes two or more step differences is located within an area along an axis, the axis extending in the longitudinal direction, which includes the valve stem receiving portion.

8. The rocker arm according to claim 1, wherein a distance between the outer side surfaces of the pair of side wall portions in the connection portion for the valve stem receiving portion is greater than a distance between outer side surfaces of the pair of side wall portions in the connection portion for the valve stem receiving portion at a position closer to the valve stem receiving portion.

9. The rocker arm according to claim 1, wherein the rocker arm is symmetrical along an axis which runs parallel to the side wall portions in the connection portion for the valve stem receiving portion and extends in a direction from the valve stem receiving portion to the pivot receiving portion.

10. The rocker arm according to claim 1, wherein the connection portion for the pivot receiving portion includes a through hole.

11. The rocker arm according to claim 1, wherein the step shape or the taper shape comprises at least three step differences.

12. The rocker arm according to claim 1, wherein the step shape or the taper shape comprises a plurality of substantially horizontal surfaces.

13. The rocker arm according to claim 1, wherein the distance between the outer side surfaces of the pair of side wall portions in the connection portion for the valve stem receiving portion is greater than a distance between outer side surfaces of the pair of side wall portions in the connection portion for the valve stem receiving portion at a position further in a direction which extends from a non-contact valve contact surface of the connection portion for the valve stem receiving portion to a valve contact surface of the connection portion for the valve stem receiving portion.

14. The rocker arm according to claim 1, wherein the pair of side wall portions comprises a step-shaped portion including an increasing height in the longitudinal direction extending from the valve stem receiving portion side of the rocker arm towards the pivot receiving portion side of the rocker arm, along the connection portion for the valve stem receiving portion.

15. The rocker arm according to claim 14, wherein the step-shaped portion in the longitudinal direction comprises a tapered step shape.

16. A rocker arm comprising:

a pair of side wall portions;

a connection portion including a valve stem receiving portion, which interconnects a plurality of inner side surfaces of the pair of side wall portions at one end thereof in a longitudinal direction;

another connection portion including a pivot receiving portion, which interconnects the inner side surfaces of the pair of side wall portions at the other end thereof in the longitudinal direction; and an open portion for arranging a roller, which is formed between the connection portion for the valve stem receiving portion and the connection portion for the pivot receiving portion, wherein a distance between a plurality of outer side surfaces of the pair of side wall portions in the connection portion including the valve stem receiving portion is reduced in a step shape or a taper shape comprising two or more step differences corresponding to a reduced distance between the outer side surfaces.

17. A method of fabricating a rocker arm comprising:

stamping a sheet of metal into a shape of the rocker arm according to claim 1.

* * * * *